US008458924B2

(12) United States Patent
Laube et al.

(10) Patent No.: US 8,458,924 B2
(45) Date of Patent: Jun. 11, 2013

(54) DRYER WITH COOLED MOTOR

(75) Inventors: Falk Laube, Berlin (DE); Holger Löffler, Berlin (DE); Andreas Ziemann, Potsdam (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 871 days.

(21) Appl. No.: 12/378,831

(22) Filed: Feb. 20, 2009

(65) Prior Publication Data

US 2009/0211107 A1 Aug. 27, 2009

(30) Foreign Application Priority Data

Feb. 22, 2008 (DE) ..... 10 2008 010 519

(51) Int. Cl.
*F26B 7/00* (2006.01)
*F26B 5/08* (2006.01)
*F26B 19/00* (2006.01)

(52) U.S. Cl.
USPC ..... 34/428; 34/218; 34/66; 34/395

(58) Field of Classification Search
USPC ..... 34/218, 260, 261, 547, 65, 66, 278, 34/378, 395, 428, 380; 310/16, 12.29, 52, 310/216.119, 227
See application file for complete search history.

(56) References Cited

U.S. PATENT DOCUMENTS

| | | | | |
|---|---|---|---|---|
| 3,771,293 | A * | 11/1973 | Vest | 55/319 |
| 6,035,552 | A | 3/2000 | Kruger et al. | |
| 2008/0113609 | A1 * | 5/2008 | Ehlers | 454/241 |

FOREIGN PATENT DOCUMENTS

| | | | |
|---|---|---|---|
| DE | 7321413 | U | 12/1974 |
| EP | 1516953 | A1 * | 3/2005 |
| JP | 02036900 | A | 2/1990 |
| JP | 02071798 | A * | 3/1990 |
| JP | 02302299 | A | 12/1990 |
| JP | 09075595 | A | 3/1997 |

* cited by examiner

*Primary Examiner* — Kenneth Rinehart
*Assistant Examiner* — John McCormack
(74) *Attorney, Agent, or Firm* — James E. Howard; Andre Pallapies

(57) ABSTRACT

The invention relates to a dryer with a housing and a drying chamber for objects to be dried, a process air duct, in which are located a heater for warming the process air and a first fan, a motor for driving the drying chamber, a heat exchanger and a cold air section in the process air duct or in a cooling air duct, with a motor cooling duct which branches off from the cold air section being able to apply cold air to the motor.

14 Claims, 2 Drawing Sheets

DRYER WITH COOLED MOTOR

BACKGROUND OF THE INVENTION

The invention relates to a dryer with a cooled motor.

A dryer in the form of a tumble dryer is in principle designed and used as a vented air dryer or as a recirculated air condenser dryer. In each case moist items of washing are dried by dry air as so-called process air first being warmed up and then directed over the moist items of washing located in a drum. The moisture contained in the washing items evaporates and is taken out of the drum in the form of warm, moist process air. In a condenser dryer the warm, moist process air is initially cooled off in a heat exchanger while the moisture is removed (condenser dryer) and subsequently, after being heated up again, is directed back into the drying chamber. With a vented air dryer on the other hand the moisture-laden air, after its passage through the laundry drum, is discharged from the vented air dryer. In this case the process air can also be cooled off by precipitation of the moisture contained within it, with heat recovery also being able to be undertaken.

A usual dryer has a housing as well as a drying chamber for objects to be dried, a process air duct, located in which are a heater for heating up the process air and a first fan, a motor for driving the drying chamber, a heat exchanger and a cold air section in the process air duct or in a cooling air duct. In this document a cold air section is used as a general term for the part which is located between an entry for cold air and a heat exchanger. As a rule air with a temperature which is largely the same as room temperature is used as cold air, i.e. which has the temperature of the room where the dryer is located.

SUMMARY OF THE INVENTION

The heating up of the motor used to drive the dryer determines its dimensioning and other design aspects. The conditions prevailing in a dryer, especially the internal temperature obtaining in the housing of up to appr. 60° C., render the removal of heat from the air surrounding the motor more difficult. With an increase in the internal temperature it becomes more difficult to transport heat away from the motor, since the motor is generally air cooled.

An object of the invention was thus to provide a dryer which allows improved operation of the motor. Preferably reliability and service life of the motor and thus of the dryer are to be improved.

An exemplary embodiment of the invention is thus a dryer with a housing as well as a drying chamber for objects to be dried, a process air duct, in which a heater for heating up the process air and a first fan are located, a motor to drive the drying chamber and a cold air section in the process air duct or in a cooling air duct, with a motor cooling duct branching off from the cold air section through which cold air can be applied to the motor.

In a preferred embodiment of the inventive dryer the cold air section is located in the process air duct. Such a dryer is embodied as a vented air dryer, in which the process air is divided into inlet air before the drying chamber and exhaust air after leaving the drying chamber.

In an alternate preferred embodiment of the inventive dryer the cold air section is located in the cooling air duct. Such a dryer is embodied as a condenser dryer.

The proportion of air flowing from the cold air section into the motor cooling duct can vary within a wide range. Preferably a part flow of air in the motor cooling duct amounts to up to 30%, especially preferably up to 20% of an overall flow in the cold air section.

A second fan is preferably located in the motor cooling duct. The motor can then be cooled especially efficiently. In this case it is preferred that the first fan and the second fan be driven by the same motor.

It is very especially preferred with this embodiment of the invention for the first fan and the second fan to be arranged on opposing sides of the motor. In an alternate preferred embodiment of the inventive dryer the first fan and the second fan form a double-flow fan.

It is very especially preferred for the motor in this embodiment to be the motor which is also used for the drive of the drying chamber.

In a further preferred embodiment of the invention a third fan is located in the cooling air duct.

The heater for heating up the process air can, for example, be an electrical resistive heater and/or a second heat exchanger. Preferably both an electrical resistive heater and a second heat exchanger are used. The second heat exchanger can be an air-air heat exchanger in which, for heating up the process air, warm air from the drying chamber or the motor space is used, or it can be the condenser of a heat pump.

For a dryer equipped with a heat pump, the cooling down of the warm, moisture-laden process air essentially occurs in the evaporator of the heat pump where the transmitted heat is used for evaporation of a refrigerant used in the heat pump circuit. The refrigerant evaporated as a result of the heating of the heat pump is fed via a compressor to the condenser of the heat pump, where, as a result of the condensation of the gaseous refrigerant, heat is released, which is used for heating up the inlet air before it enters the drying chamber (drum).

Since, as the degree of drying of the objects to be dried in the vented air dryer progresses, the energy required for drying reduces, the heater is expediently regulated accordingly, i.e. its heating power is reduced as the degree of drying increases.

The inventive dryer has the advantage that the improved cooling allows the motor of the dryer to be operated at a lower temperature compared to that of a conventional dryer. The danger of the motor stopping through overheating is reduced and thus the likelihood of a failure of the motor overall. Finally the motor temperature itself can be held at the same level using less material (reduced core length). The active cooling of the motor enables it to be designed smaller in respect of laminated core and winding, so that a cost benefit without loss of function can be achieved.

BRIEF DESCRIPTION OF THE DRAWINGS

Further details of the invention emerge with reference to FIGS. 1 and 2 from the subsequent description of non-restrictive exemplary embodiments for the inventive dryer and the method for its operation.

DETAILED DESCRIPTION OF EXEMPLARY EMBODIMENTS OF THE PRESENT INVENTION

Figure 1:
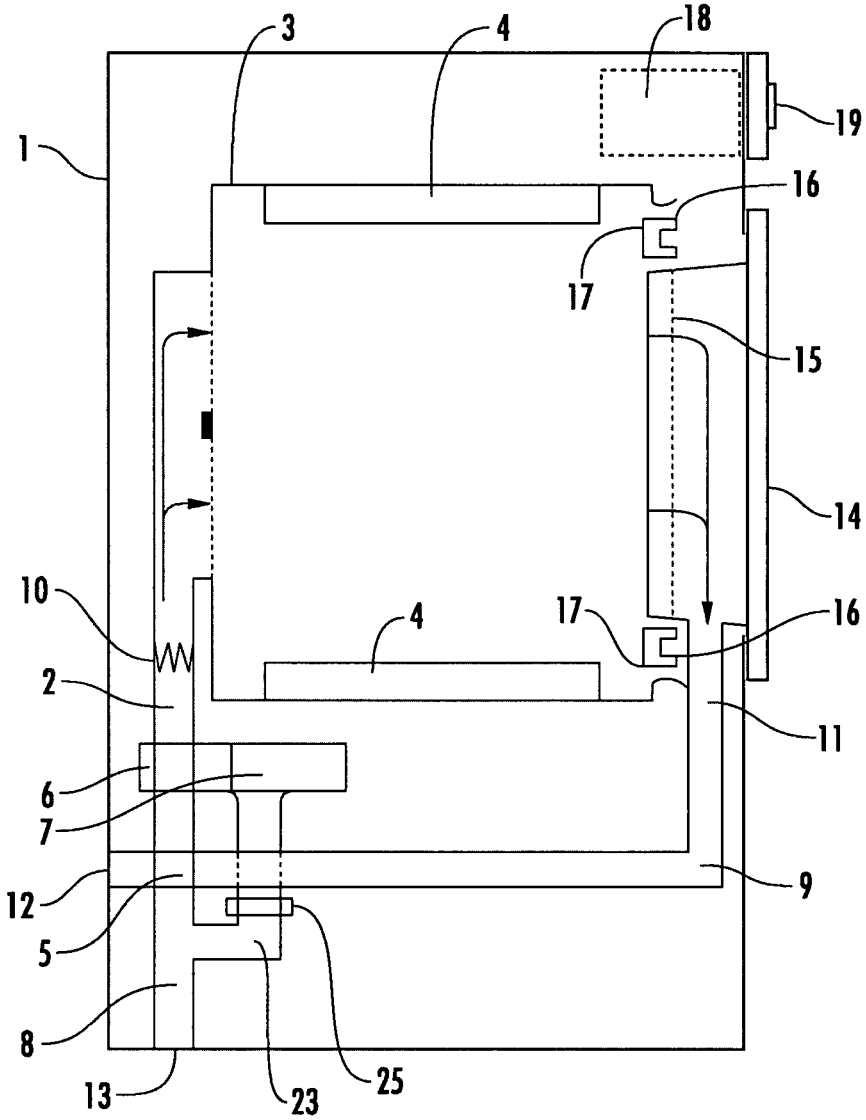
FIG. 1 shows a vertical section through a dryer which is embodied as a vented air dryer.
Figure 2:
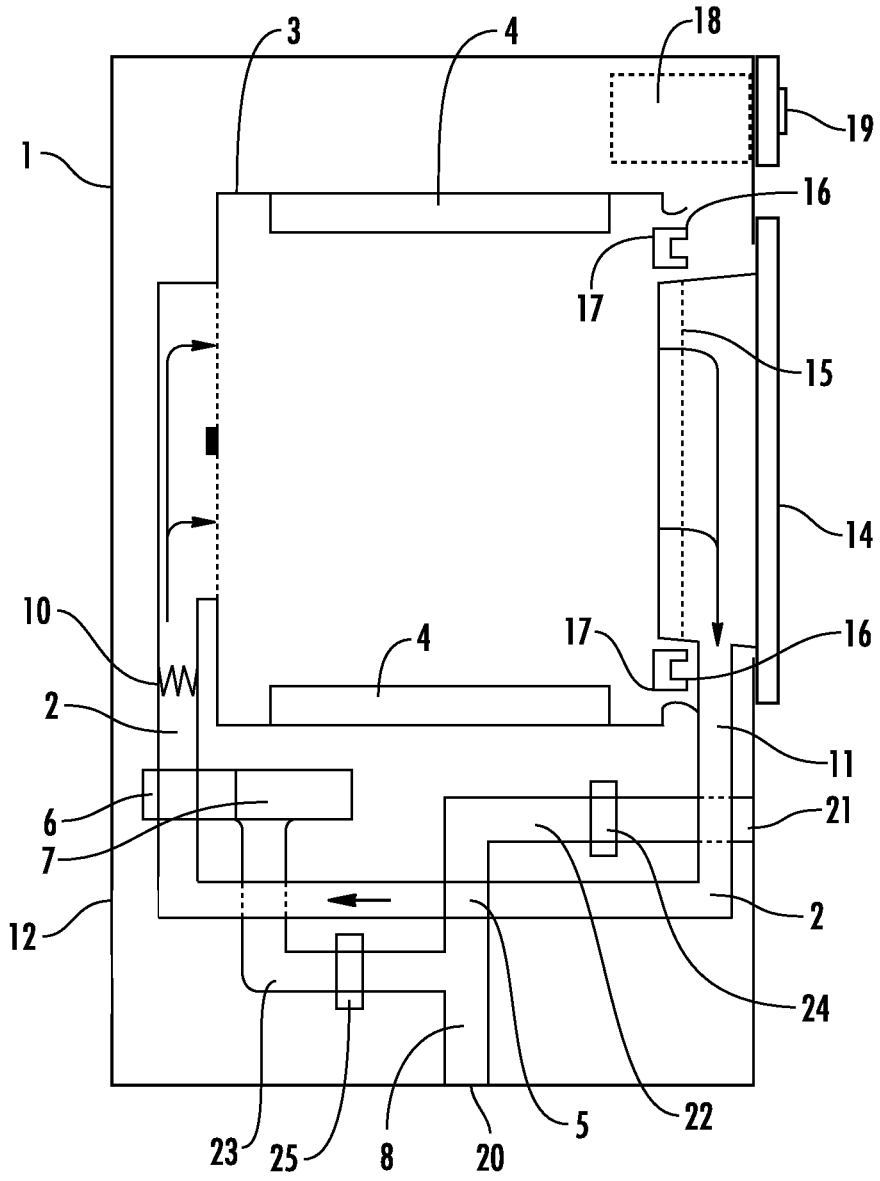
FIG. 2 shows a vertical section through a dryer which is embodied as a condenser dryer.

The arrows in FIGS. 1 and 2 indicate the direction of flow of the process air.

The dryer shown in FIG. 1 features a drum rotatable around a horizontal axis in a housing 1 as its drying chamber 3, within which agitators 4 are attached to move the washing as the drum turns. Inlet air is carried in the process air duct 2 by means of a first fan 6 from inlet air entry 13 via an air-air heat exchanger 5 and an electrical heater 10 through the drum 3. The cold air section 8 here refers to the part of the process air duct 2 from the inlet air entry 13 to the air-air heat exchanger 5. Branching off from the cold air section 8 is a motor cooling duct 23 to the motor 7, to cool the latter by supplying it with cold air.

After exit from the drum 3, the moisture-laden process air is directed into a part of the process air duct 2 referred to here as the outlet duct 9 via the air-air heat exchanger 5 to an exhaust air outlet 12. In this case air heated by the electrical heater 10 is directed from behind, i.e. from the side of the drum lying opposite a door 10, through its perforated floor into the drum 3, where it comes into contact with the washing to be dried and flows through the fill opening of the drum 3 to a lint filter 15 within a door 14 closing off the fill opening. Subsequently the flow of air is diverted downwards in the door 14 and directed onwards in the outlet duct 9 to the air-air heat exchanger 5. There, as a result of cooling down, the moisture extracted by the process air from the items of washing condenses and is collected in a condensation dish not shown in any greater detail here. The cooled and dehumidified process air leaves the outlet duct 9 as exhaust air at the exhaust air outlet 12.

In this embodiment there is a second fan 25 in the motor cooling duct 23.

In the embodiment shown in FIG. 1 the drum 3 is supported on the rear floor by means of a rotary bearing and at the front by means of an end shield 16, with the drum 3 resting with a brim on a slider strip 17 on the end shield 16 and thus held at its front end. The vented air dryer is controlled via a control device 18 which can be controlled by the user via a control unit 19.

In the embodiment shown in FIG. 1 the first fan 6, the second fan 25 as well as the drum 3 are driven by the same motor 7, with the first fan 6 and the second fan 25 being located on opposite sides of motor 7.

FIG. 2 shows a vertical section through a dryer which is embodied as a condenser dryer. This embodiment thus does not have an inlet air entry and an outlet duct. Unlike the embodiment of FIG. 1, the cooling down of the warm moisture-laden process air from the drying chamber 3 is undertaken in the air-air heat exchanger 5 through heat exchange with cool air in a cooling air duct 22. In this embodiment of the invention the cold air section 8 is located in the cooling air duct 22. The cold air section 8 extends especially from a cooling air entry 20 to heat exchanger 5. Branching off from the cold air section 8 is a motor cooling duct 23 to the motor 7, to cool the latter by supplying it with cold air. Located in the motor cooling air duct 23 is a second fan 25. Located in the cooling air duct 22 is a third fan 24, which conveys cool air from a cool air entry 20 through the air-air heat exchanger 5 to the cool air outlet 2 1.

In the embodiment shown in FIG. 2 in which the dryer is a condenser dryer, the cold air for cooling down motor 6 originates from a separate cooling air duct. Thus in this embodiment, as is also shown in FIG. 2, the additional use of a third fan 24 in the cooling-air duct can be worthwhile. The parts of the dryer not explained separately for FIG. 2 correspond to the parts and their functions described for FIG. 1.

The invention claimed is:

1. A dryer, comprising:

a drying chamber for objects to be dried;

an inlet air entry;

a first air duct in communication with the inlet air entry, the first air duct being provided with a motor, a first fan at a first side of the motor, and a cold air section which provides a first flow of air by which the objects in the drying chamber are dried and also provides a second flow of air by which the motor is cooled.

2. The dryer of claim 1, further comprising a second duct in communication with the first duct, the second air duct being provided with a second fan at a second, opposite side of the motor.

3. The dryer of claim 2, wherein the second flow of air flows through the second duct.

4. A dryer, comprising:

a housing;

a drying chamber for objects to be dried;

a process air duct in which are located a heater for warming up the process air, a first fan, a motor for driving the drying chamber, a heat exchanger, and a cold air section, a motor cooling duct that branches off from the cold air section through which a first flow of cold air is able to be applied to the motor, and a second fan in the motor cooling duct, wherein the cold air section provides a second flow of cold air which is processed by the heater to dry the objects in the drying chamber.

5. The dryer of claim 4, wherein the cold air section is in the process air duct.

6. The dryer of claim 4, wherein the cold air section is located in the cooling air duct.

7. The dryer of claim 4, wherein the first flow of cold air comprises up to 30% of the overall air flow in the cold air section.

8. The dryer of claim 1, wherein the first fan and the second fan form a double-flow fan.

9. The dryer of claim 1, further comprising a third fan in the cooling air duct.

10. A dryer, comprising:

a process air duct through which a flow of air flows;

a motor;

a heater provided in the process air duct;

a drying chamber for objects to be dried;

a first fan provided in the process air duct;

a motor cooling duct which directs cool air to the motor;

a second fan provided in the motor cooling duct; and a cold air section provided in the process air duct, the cold air section providing a first flow of air which is processed by the heater to dry the objects in the drying chamber and a predetermined amount of a second flow of air which is processed by the second fan to cool the motor.

11. The dryer of claim 10, wherein the predetermined amount comprises up to 30% of the overall air flow in the cold air section.

12. The dryer of claim 10, wherein the predetermined amount comprises up to 20% of the overall air flow in the cold air section.

13. The dryer of claim 10, wherein the motor drives the drying chamber, the first fan and the second fan.

14. The dryer of claim 10, further comprising a heat exchanger which cools down the flow of air from the drying chamber.

* * * * *